US005176715A

United States Patent [19]

Horn

[11] Patent Number: 5,176,715

[45] Date of Patent: Jan. 5, 1993

[54] PROCESS FOR DYEING CELLULOSIC FIBER MATERIALS WITH VAT DYES: DOSING CONTINUOUSLY OVER TIME INTERVAL

[75] Inventor: Peter J. Horn, Basle, Switzerland

[73] Assignee: Ciba-Geigy Corporation, Ardsley, N.Y.

[21] Appl. No.: 741,388

[22] Filed: Aug. 7, 1991

[30] Foreign Application Priority Data

Aug. 8, 1990 [CH] Switzerland ..... 2582/90

[51] Int. Cl.[5] ..... D06P 3/60; D06P 5/00; C09B 9/00; C09B 67/28

[52] U.S. Cl. ..... 8/400; 8/650; 8/651; 8/653; 8/154; 8/918

[58] Field of Search ..... 8/400, 650, 651, 653

[56] References Cited

U.S. PATENT DOCUMENTS

| | | | |
|---|---|---|---|
| 2,257,235 | 10/1958 | Coscia | 8/400 |
| 4,372,744 | 2/1983 | Hildebrand et al. | 8/400 |
| 4,562,604 | 1/1986 | Damm | 8/158 |
| 4,629,465 | 12/1986 | Hasler et al. | 8/400 |
| 4,645,510 | 2/1987 | Hasler et al. | 8/400 |
| 4,737,157 | 4/1988 | van der Eltz et al. | 8/543 |
| 4,746,324 | 5/1988 | von der Eltz et al. | 8/549 |
| 4,820,312 | 4/1989 | von der Eltz | 8/533 |
| 5,114,427 | 5/1992 | Damm | 8/400 |

FOREIGN PATENT DOCUMENTS

| | | |
|---|---|---|
| 3515406 | 10/1986 | Fed. Rep. of Germany . |
| 3515407 | 10/1986 | Fed. Rep. of Germany . |

OTHER PUBLICATIONS

Chemical Abstracts 100:233065e (1989).

*Primary Examiner*—A. Lionel Clingman

*Attorney, Agent, or Firm*—Marla J. Mathias; Edward McC. Roberts

[57] ABSTRACT

There is disclosed a process for dyeing cellulosic fibre materials with vat dyes, which comprises adding to the dyebath all or some of the auxiliary chemicals required for the dyeing process, and subsequently, after a pretratment time, adding the vat dye or its leuco form with the aid of a metering device to the dyebath, and dyeing the fiber materials by optionally increasing the temperature of the dyebath.

Level dyeings are obtained with the novel process, the cellulosic material having a perfectly level appearance as well as good light- and wetfastness properties.

9 Claims, No Drawings

PROCESS FOR DYEING CELLULOSIC FIBER MATERIALS WITH VAT DYES: DOSING CONTINUOUSLY OVER TIME INTERVAL

The present invention relates to a process for dyeing textile cellulosic materials with vat dyes with the aid of a metering device and to the cellulosic material dyed by said process.

In the art of vat dyeing it is known that, compared with conventional processes such as hot pigmenting or the leuco process, the levelness of dyeings can be enhanced by the metered addition of customary chemicals such as aqueous sodium hydroxide, hydrosulfite and, if desired, Glauber's salt or sodium chloride. Basically two methods of metering are used:

1. Adding dyeing auxiliaries, dye, sodium carbonate and hydrosulfite to the dyebath at 20° C., with subsequent progressive metered addition of aqueous sodium hydroxide over 20 minutes.

2. Adding the dye to the dyebath at 40° C., with subsequent linear metered addition of hydrosulfite over 15 minutes at 80° C. When using so-called warm-dyeing dyes, the further linear metered addition of a salt solution can be made over 15 minutes before and during the cooling phase in the temperature range from 80° to 60'° C.

However, especially in wound package dyeing, metering technology has not led entirely to the hoped for advantages in respect of enhancing fibre levelness.

Surprisingly, it has now been found that the fibre levelness, especially the outside/inside levelness of wound packages, is markedly enhanced by means of a process in which the chemicals required for the dyeing process are added to the dyebath, followed by the metered addition of the dye or the stock vat.

Specifically, the present invention relates to a process for dyeing cellulosic fiber materials with vat dyes, which comprises adding to the dyebath all or some of the auxiliary chemicals required for the dyeing process, subsequently adding the vat dyes or their leuco compounds with the aid of a metering device over an interval of time to the dyeing bath at temperatures of 20° to 100° C., and thereafter dyeing the fiber material at the same or increased temperature.

The metered addition of the dye or the leuco compound is conveniently made continuously over a specific interval of time until the dye has been added in an amount sufficient for the respective dyeing procedure. The metered addition can be made linearly in respect of time, i.e. always the same amount of dye is added during the metering phase over each interval of time. Another possibility consists in the degressive metered addition of the dye, i.e. the amount of dye added per unit of time is very large at the start of the metering phase and then continuously decreases with increasing duration of the metered addition. Optionally the metered addition of the dye can be mode in the progressive way, i.e. the amount of dye added per unit of time is very small at the start of metering phase and then continuously increases with increasing duration of the metered addition.

The metered addition of the dye or leuco compound is conveniently made direct to the circulating liquor, preferably with automatically controlled devices. Suitable for liquid metering are, for example, pneumatically or electrically driven piston-membrane pumps. These pumps are provided with a microprocessor control unit with which the control parameters necessary for the respective dyeing process can be adjusted, for example the amount of dye to be metered, the metering time, the "degressivity" or "progressivity". The control devices can also be provided with fixed metering programs.

The vat dyes added to the dyebath in liquid metered addition are conveniently used in the form of fine dispersions which are obtained by milling in the presence of conventional dispersants.

It is preferred to use dye dispersions in which the crude dye is coarse milled only for homogenisation, using as milling auxiliaries minor amounts of nonionic and/or anionic dispersants.

To stabilize these dispersions, the viscosity is preferably adjusted to values from $1\times10^3$ to $2\times10^4$ mPas with commercially available thickners, preferably those based on polymeric acrylic acid.

The dispersants may suitably be anionic or nonionic surfactants which are used by themselves or as mixtures with one another, or they consist of an anionic and a nonionic surfactant.

Typical examples of suitable anionic surfactants are:

sulfated aliphatic alcohols which contain 8 to 18 carbon atoms in the alkyl chain, for example sufated lauryl alcohol;

sulfated unsaturated fatty acids or fatty acid $C_1$–$C_5$alkyl esters which contain 8 to 20 carbon atoms in the fatty radical, typically ricinic acid and oils containing such fatty acids, for example castor oil;

alkylsulfonates containing 8 to 20 carbon atoms in the alkyl chain, for example dodecylsulfonate;

alkylarylsulfonates with linear or branched chain containing not fewer than 4 carbon atoms, for example dodecylbenzenesulfonates or 3,7-diisobutylnaphthalenesulfonates;

sulfonates of polycarboxylates, for example dioctyl sulfosuccinate;

the alkali metal salts, ammonium salts or amine salts of fatty acids containing 10 to 20 carbon atoms classified as soaps, for example rosin salts;

esters of polyalcohols, especially mono- or diglycerides of fatty acids containing 12 to 18 carbon atoms, for example monoglycerides of lauric, stearic or oleic acid; and the polyadducts of 1 to 60 mol of ethylene oxide and/or propylene oxide with fatty amines, fatty acids or fatty alcohols, each containing 8 to 22 carbon atoms, with alkylphenols containing 4 to 16 carbon atoms in the alkyl chain, or with trihydric to hexahydric alkanols containing 3 to 6 carbon atoms, which adducts are converted into an acid ester with an organic dicarboxylic acid such as maleic acid or sulfosuccinic acid, but preferably with an inorganic polybasic acid such as o-phosphoric acid or sulfuric acid.

The anionic surfactants will normally be in the form of their alkali metal salts, ammonium salts or amine salts.

Typical examples of nonionic surfactants are:

polyadducts of preferably 5 to 80 mol of alkylene oxides, preferably ethylene oxide, in which adducts individual ethylene oxide units may be replaced by substituted epoxides such as styrene oxide and/or propylene oxide, with higher unsaturated or saturated fatty alcohols, fatty acids, fatty amines or fatty amides of 8 to 22 carbon atoms, or with phenylphenols or alkylphenols containing not fewer than 4 carbon atoms in the alkyl moiety;

condensates of alkylene oxide, preferably ethylene oxide and/or propylene oxide; and reaction products of a fatty acid containing 8 to 22 carbon atoms and a primary or secondary amine containing at least one hydroxy-lower alkyl group or lower alkoxy-lower alkyl group, or polyadducts of alkylene oxide with said hydroxyalkylated reaction products, the reaction being carried out such that the ratio of hydroxyalkylamine to fatty acid can be 1:1 and greater than 1, for example 1:1 to 2:1.

Further suitable dispersants which may be used are aromatic sulfonic acids, such as oxyligninsulfonic acid, or condensates of formaldehyde and aromatic sulfonic acids, formaldehyde and mono- or bifunctional phenols, typically of cresol, β-naphtholsulfonic acid and formaldehyde, of benzenesulfonic acid, formaldehyde and naphthalenesulfonic acid, or of naphthalenesulfonic acid, dihydroxydiphenylsulfone and formaldehyde.

Preferred suitable cellulosic material is non-pretreated cellulose such as hemp, linen, jute, natural cotton, as well as fibre blends such as polyacrylonitrile/-cotton or polyester cotton blends; further fiber materials on the basis of regenerated cellulose such as viscose. The cellulosic material may be in any form of presentation, for example loose material, yarn, woven or knitted fabrics. Cotton processed as yarn is preferred for the process of this invention.

Depending on the technical requirements, the cotton is dyed in the form of the hank, of the compressed or noncompressed cheese or of the warp beam. In principle it is possible to use all dyeing methods in which dyeing is carried out with agitated liquor and stationary fibre material. In the process of this invention it is preferred to dye the fibre material in cheese form. The cheeses for the dyeing process are mounted on perforated metal spindles or triangular spindles into which the liquors are forced. Further particulars on the dyeing of yarn and the apparatus therefor will be found in H. Rath, "Lehrbuch der Textilchemie" (Textbook of Textile Chemistry), 3rd Edition, p. 642 et seq. (1972).

The vat dyes used are highly condensed and heterocyclic benzoquinones or naphthoquinones and, preferably, anthraquinoid or indigoid dyes. Illustrative examples of vat dyes eligible for use in the process of this invention are listed in the Colour Index 3rd Edition (1971), Vol. 3, on pages 3649 to 3837 under the heading "Vat Dyes".

The amount of dye added to the dye liquor will depend on the desired colour strength. Amounts of 0.01 to 10 percent by weight, preferably of 0.05 to 3 percent by weight, based on the cellulosic material, have generally been found useful.

In addition to the dye, the dye liquors contain the customary auxiliary chemicals used in vat dyeing. These chemicals include typically alkali such as sodium carbonate, potassium hydroxide, sodium hydroxide or an alkali donor such as sodium chloroacetate. It is preferred to use sodium hydroxide. Reducing agents may also be mentioned, among which it is preferred to use hydrosulfite.

The dye liquor can additionally contain still further dyeing auxiliaries such as electrolytes, typically sodium chloride or sodium sulfate or commercially available wetting, levelling and dispersing agents. All or some of these auxiliary chemicals are added to the dyebath before the actual dyeing process, if only some of the chemicals are added the rest is added together with the vat dye or leuco compound.

Dyeing is conveniently carried out from an aqueous liquor by the exhaust process. The liquor ratio depends on the type of apparatus used, on the substrate and on the make-up of the fibre material. It can, however, be chosen over a wide range from 1:4 to 1:100, but is normally from 1:6 to 1:15.

The dyeing process of this invention can be carried out in the temperature range from 20° to 110° C., the preferred range being from 30° to 100° C. or 30° to 80° C.

The dyeing process is conveniently carried out by adding all the chemicals to the dye liquor and pretreating the fibre material in the temperature range from 20° to 100° C., preferably 20° to 80° C. The pretreatment time is from about 5 to 20, preferably 5 to 15 or 5 to 10 minutes. The entire amount of dye is then metered linearly, degressively or progressively, at the same and constant temperature, over a period of 15 to 40, preferably 20 to 40 minutes. The temperature of the dyebath is then raised to 60°-110° C. over 15 to 25 minutes at a corresponding constant rate of heating up, and dyeing is carried out for 30 to 60 minutes, when the final temperature is reached. Dyeing can also, however, be carried out isothermally, i.e. at constant temperature. After dyeing, the dye liquor is cooled to 50°-70° C. The dyed material is rinsed and oxidised in conventional manner, for which last mentioned treatment hydrogen peroxide is normally used.

After the dyeing procedure the dyed cellulosic material is soaped in conventional manner. This is done by treating the substrate at boiling temperature in a solution which contains soap or synthetic detergent and optionally sodium carbonate.

Level and intense dyeings of good colour yield are obtained with the process of this invention. In particular, level dyeings are obtained, the cellulosic material having a perfectly level appearance and good light- and wetfastness properties.

In the following Examples percentages are by weight, unless otherwise stated. The quantities of dye refer to commercial, i.e. diluted, product, and the quantities of auxiliaries to pure substance.

PREPARATION OF DYE DISPERSIONS

Example 1

100 parts of the dye formulation comprising
29.4 parts of the dye of formula

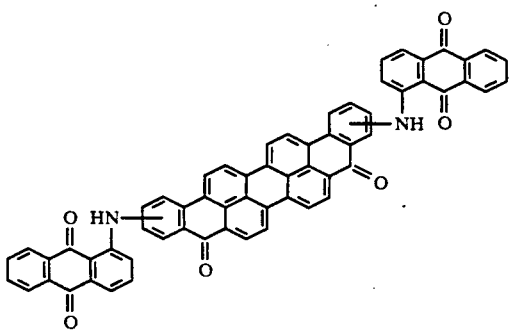

(101)

1.6 parts of ethylene oxide/propylene oxide block polymer having a molecular weight of c. 16 000
64.6 parts of water
are milled in a microsol mill with 4.5 mm glass balls for about 45 minutes and the homogeneous mixture obtained is adjusted with
5.4 parts of 0.1N $H_2SO_4$ to pH 4 and homogenised with 1 part of polyacrylic acid (molecular weight c. $3\times10^6$) in a stirred vessel with a propeller stirrer. The polyacrylic acid is added in the form of a 3% aqueous solution. The pH of the homogeneous mixture is adjusted to 7.0 with triethanolamine, whereby the mixture takes on a puddingy consistency which prevents sedimentation of the coarse dye particles.

Example 2

100 parts of the dye formulation comprising
18.0 parts of the dye of formula

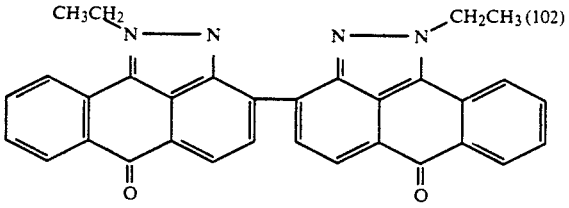

0.6 part of ethylene oxide/propylene oxide block polymer having a molecular weight of c. 16 000, and
64.6 parts of water
are milled in a microsol mill with 4.5 mm glass balls for about 45 minutes and the homogeneous mixture obtained is adjusted with
16 parts of 0.1N $H_2SO_4$
to pH 4 and homogenised with 1.1 part of polyacrylic acid (molecular weight c. $3\times10^6$) in a stirred vessel with a propeller stirrer. The polyacrylic acid is added in the form of a 3% aqueous solution. The pH of the homogeneous mixture is adjusted to 7.0 with triethanolamine.

Example 3

100 parts of the dye formulation comprising
2.8 parts of ethylene oxide/propylene oxide block polymer having a molecular weight of c. 16 000, and
82.1 parts of water
are milled in a microsol mill with 4.5 mm glass balls for about 45 minutes and the homogeneous mixture obtained is adjusted with
0.01 part of 0.1N $H_2SO_4$
to pH 4 and homogenised with 1.1 parts of polyacrylic acid (molecular weight c. $3\times10^6$) in a stirred vessel with a propeller stirrer. The polyacrylic acid is added in the form of a 3% aqueous solution. The pH of the homogeneous mixture is adjusted to 7.0 with triethanolamine.

APPLICATION EXAMPLES

Example 4

Three 900 g compressed packages (degree of compression 15%) of cotton which have been pretreated with alkali are treated in a circulating liquor dyeing machine, for example a THIES Ecomat Series II, type 260/3 K-D, with a liquor (goods to liquor ratio 1:12.5) which contains the following auxiliaries:
0.5 g/l of an antifoam based on 2-ethylhexanol and silicone oil,
0.5 g/l of a dispersant based on oxyligninsulfonate
1.0 g/l of a complexing agent
1.0 g/l of a polyamide-based levelling agent
5 ml/l an aqueous sodium hydroxide solution (30%) and 60 g of hydrosulfite.

The pretreatment time is 10 minutes at 40° C. The treatment is carried out with unidirectional inside/outside circulation. The liquor passage flow rate is about 71/kg/min.

Dyeing is subsequently carried out in the same bath, also with unidirectional inside/outside circulation. The following dye mixture is used:
3.25 g of the dye of formula (102)
4.05 g of the dye of formula

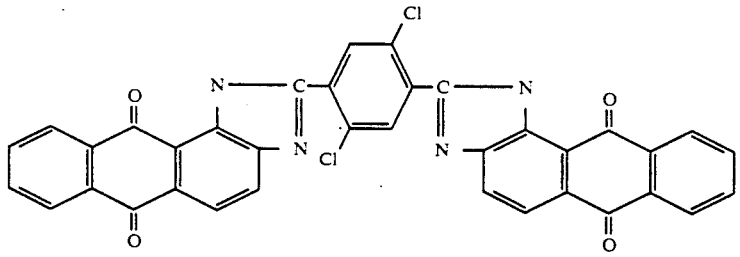

(104)

15.1 parts of the dye of formula and 5.40 g of the dye of formula

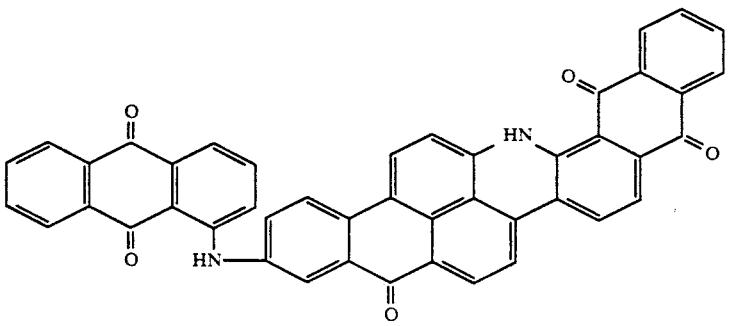

(103)

(105)

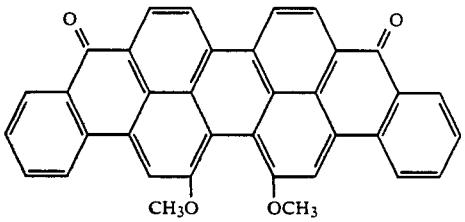

This dye mixture is dispersed with 11 g of oxyligninsulfonate in 2 liters of water.

Analogously one of the dye dispersions according to Examples 1 to 3 can be used.

The liquor is warmed to 40° C. Linear metered addition of the dispersed dye mixture is made at a rate of about 60 ml/min at this temperature over 30 minutes. The dye liquor is then heated to 80° C. at a heating rate of 1.5° C./min. Dyeing is continued for 45 minutes at this temperature and the liquor is then cooled to 60° C. at a cooling rate of 2° C./min. The dyed fibre material is then removed from the dyeing machine and oxidised with hydrogen peroxide. The dyeing is subsequently finished in conventional manner.

Example 5

The procedure of Example 4 is repeated, except that 200 ml of sodium hydroxide and 40 g of hydrosulfite are used in the liquor instead of 300 ml of sodium hydroxide and 60 g of hydrosulfite, and that 100 ml of sodium hydroxide and 20 g of hydrosulfite are further added to the dye mixture and the leuco form of the dye so obtained is metered.

Example 6

Two 1050 g compressed packages (degree of compression 15%) of cotton are pretreated in a circulating liquor dyeing machine, for example a THIES Ecomat Series II, type 260/3 K-D, with a combined peroxide bleaching liquor (goods to liquor ratio 1:12.5) which contains the following auxiliaries:

10 ml/l of $H_2O_2$ (35%)
6 ml/l an aqueous sodium hydroxide solution (30%)
1 ml/l of a bleaching stabiliser
0.5 g/l of a silicone-free penetration accelerator.

The material is put into this liquor at 40° C., and the liquor is heated to 110° C. over 30 minutes. Treatment is continued for a further 30 minutes at this temperature. The temperature is then lowered to 85° C. over 15 minutes, and the goods are subsequently rinsed in conventional manner.

For dyeing, the bleached cheeses are pretreated in the same apparatus with a liquor (goods to liquor ratio 1:12) containing the following auxiliaries:

0.3 g/l of a silicone-free penetration accelerator
3.0 g/l of oxyligninsulfate (30%)
14 ml/l an aqueous sodium hydroxide solution (30%)
0.5 g/l of a benzotriazole levelling agent
4.0 g/l of hydrosulfite.

The pretreatment time is 15 minutes at a temperature of 80° C. The pretreatment is carried out with unidirectional inside/outside circulation.

Dyeing is carried out in the same bath, also with unidirectional inside/outside circulation. The following dye mixture is used:

0.052% of the dye of formula (104),
0.048% of the dye of formula (105)
0.276% of the dye of formula (106)

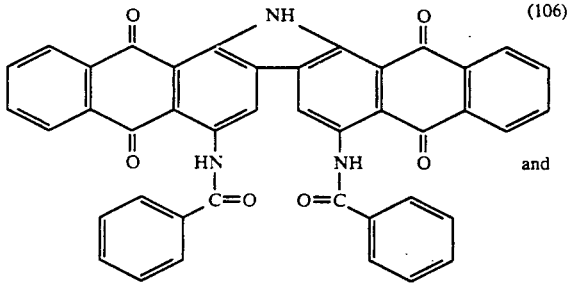

and 0.040% of the dye of formula (107)

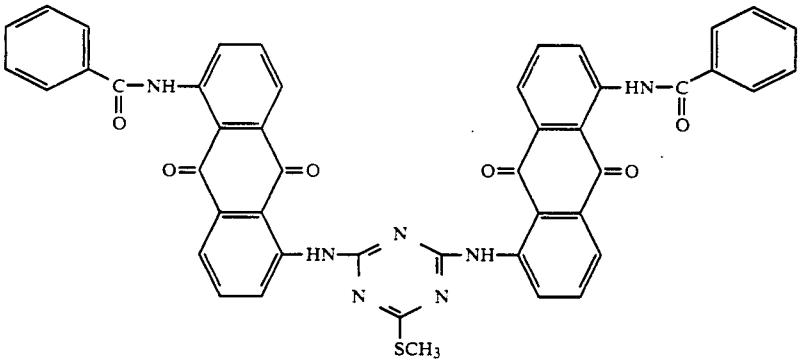

This dye mixture is coarsely dispersed with 11 g of oxyligninsulfonate in 2 liters of water.

Linear metered addition is made of the dispersed dye mixture at 80° C. over 15 minutes at a rate of addition of about 120 ml/min. Isothermal dyeing is carried out for a further 30 minutes, and the liquor is then cooled to 60° C. at a cooling rate of 1.5° C./min. The dyed material is then removed from the dyeing machine and oxidised with hydrogen peroxide. The dyeing is subsequently finished in conventional manner.

Example 7

The procedure of Example 6 is repeated, except that 830 g compressed packages of viscose yarn (Nm 131/2) are used.

Further, the bleached cheeses are pretreated with a liquor containing the following auxiliary chemicals:

0.5 g/l of a silicone-free penetration accelerator 3.0 g/l of oxyligninsulfonate (30%)
14 ml/l of an aqueous sodiumhydroxide solution (30%)
0.2 g/l of a benzotriazole levelling agent
3.5 g/l of hydrosulfite.

The pretreated time is 15 minutes at a temperature of 90° C.

Dyeing is carried out in the same bath. The following dyeing mixture is used:
0.07% of the dye of formula (104)
0.05% of the dye Vat Red 10 (C.J. No. 67000)
0.004% of the dye of formula (108)

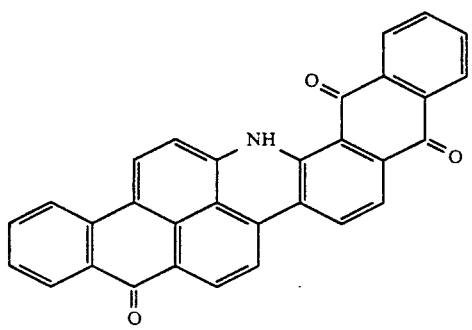

The dye mixture is coarsely dispersed with 10 g of oxyligninsulfonate in 2 liters of water.

The cheeses are uniformly dyed.

I claim:

1. A process for dyeing cellulosic fiber materials with a vat dye, which comprises adding to a dyeing bath all or some of the alkaline compounds or alkali donors and reducing agents, and further auxiliary chemicals, required for the dyeing process, pretreating the fiber material at temperatures of 20° to 100° C. in said dyeing bath, subsequently adding the vat dye or its leuco compound continuously over an interval of time to the dyeing bath at temperatures of 20° to 100° C., and thereafter dyeing the fiber material at temperatures of 20° to 110° C.

2. A process according to claim 1, wherein the dyeing is carried out in the dyeing bath which is heated to a temperature of 20° to 110° C.

3. A process according to claim 1, wherein the vat dye or its leuco compound are added at a constant, decreasing or increasing rate.

4. A process according to claim 1, wherein the vat dye or its leuco compound have been coarsely milled.

5. A process according to claim 1, wherein the cellulosic fibre material is yarn of cotton or regenerated cellulose.

6. A process according to claim 1, wherein the cellulosic fiber material is compressed or non-compressed cheese.

7. A process according to claim 1, wherein the pretreatment time is from 5 to 20 minutes.

8. A process according to claim 1, wherein the interval of time for adding the vat dye or its leuco compound is from 15 to 40 minutes.

9. The fibre material dyed by a process according to claim 1.

* * * * *